US005421051A

United States Patent [19]

Patten

[11] Patent Number: 5,421,051

[45] Date of Patent: Jun. 6, 1995

[54] BASCULE BRIDGE WITH HINGED SECTION

[76] Inventor: Roger W. Patten, 1215 SW. 149th, Seattle, Wash. 98166

[21] Appl. No.: 63,502

[22] Filed: May 18, 1993

Related U.S. Application Data

[63] Continuation-in-part of Ser. No. 680,943, Apr. 5, 1991, abandoned.

[51] Int. Cl.[6] ..... E01D 15/06; E01D 15/10

[52] U.S. Cl. ..... 14/37; 14/43

[58] Field of Search ..... 14/31-32, 14/35-37, 41, 43

[56] References Cited

U.S. PATENT DOCUMENTS

| | | | |
|---|---|---|---|
| 173,253 | 2/1876 | Adams et al. | 14/38 |
| 379,861 | 3/1888 | Cornell | 14/38 |
| 383,880 | 6/1888 | Harman | 14/37 |
| 503,377 | 8/1893 | Lamont | 14/37 |
| 534,704 | 2/1895 | Worden | 14/37 |
| 598,168 | 2/1898 | Waddell | 14/41 |
| 683,627 | 10/1901 | Vent | 14/41 |
| 1,078,293 | 11/1913 | Leslie | 14/37 |
| 2,556,175 | 6/1951 | Frost | 14/37 |
| 2,740,145 | 4/1956 | Loser | 14/38 |
| 4,169,296 | 10/1979 | Wipkink et al. | 14/35 |

FOREIGN PATENT DOCUMENTS

| | | |
|---|---|---|
| 324342 | 6/1963 | France . |
| 387897 | 1/1924 | Germany . |

*Primary Examiner*—Stephen C. Pellegrino

*Assistant Examiner*—Nancy Mulcare

*Attorney, Agent, or Firm*—Christensen, O'Connor, Johnson & Kindness

[57] ABSTRACT

A drawbridge apparatus for reversibly spanning from a first pier to a second pier. The apparatus comprises first and second cantilevered beams, rack and pinion beam drive mechanisms, first and second bascular leaves, first and second hinged leaves, and rack and pinion leaf drive mechanisms. The first and second cantilevered beams are slidably coupled to the first and second piers, respectively. The beams are arranged and configured to project from the first and second bases to a location between the two where the beams make a locking interconnection when the bridge is in its down configuration. The beam drive mechanisms cause the first and second cantilevered beams to slide from and into the first and second bases, respectively. The first and second bascular leaves have first and second counterweight portions and first and second span portions, respectively. The bascular leaves are pivotally coupled to the bases at the intersections of the counterweight portions with the span portions. The first and second hinged leaves have first and second base ends. These base ends are pivotally coupled to the first and second span portions of the bascular leaves. The hinged leaves also have first and second extended ends slidably coupled to the first and second cantilevered beams, respectively. Finally, the leaf drive means are arranged and configured for pivoting the first and second bascular leaves.

17 Claims, 8 Drawing Sheets

BASCULE BRIDGE WITH HINGED SECTION

CROSS-REFERENCE TO RELATED APPLICATION

This application is a continuation-in-part of application Ser. No. 07/680,943, filed Apr. 5, 1991, now abandoned.

FIELD OF THE INVENTION

This invention relates generally to a drawbridge apparatus, and more particularly to a bascule bridge with a hinged section supported by a cantilevered bayonet beam.

BACKGROUND OF THE INVENTION

Bascular bridges are often used as drawbridges for pedestrian, vehicular, and railroad traffic. A bascular design for a drawbridge is advantageous since bridges typically comprise large, heavy structural components which are difficult to lift. A counterbalanced bascular bridge makes lifting the bridge deck easier. A large amount of energy is required just to star the heavy bridge moving without having to lift all of the bridge's weight. However, by counterbalancing the bridge, weight is necessarily added to the entire structure, making the whole a very cumbersome device to move quickly. Thus traffic is typically tied up waiting long periods for the bridge to open sufficiently for boats to pass and then to slowly close again.

Weight is also added to the typical drawbridge due to its cantilevered construction. The two sides of the bridge project inwardly and are essentially two simple cantilevered beams. Heavy loads at the end of a simple cantilevered beam (the location corresponding to the center of the bridge) are difficult to carry and, as a result, the bridge must have a heavy duty construction.

Attempts at solving this problem have taken two approaches. The first approach is centered on connecting the two bridge sections in the middle so that they operate as a single rigid span. The patent to Vent (U.S. Pat. No. 683,627) is an example of such a bridge. I The problems with such a construction include a complicated interconnect arrangement due to the fact that the bridge sections are pivoting down into place. The complexity may affect the strength of the interconnection, the cost of construction, and the speed of connection. Added weight that must then be lifted when opening the bridge is also a result of this construction. This added weight is necessarily in the location most difficult to lift.

The second approach involves the two bridge sections meeting at their ends and bearing against each other at a point sufficiently above their pivotal or rolling supports to cause them to operate as an arch construction. The patent to Adams et al. (U.S. Pat. No. 173,253) is an example of this basic construction. The arch construction imposes oblique loads or stresses upon the foundations, causing them to settle unevenly and become distorted in shape. It also poses alignment problems as the proper mating of the ends of the section is critical to the proper distribution of the loads. Another obvious problem is the resultant arched road surface. This may be overcome by appropriate build up of the sections, but such build up adds weight.

Other problems arise with typical drawbridges due to their span. For example, with the bridge in an open position high winds exert tremendous forces on the bridge deck. To protect against failure, added structural support to account for these forces must be provided.

Attempts to solve the problems associated with the long span have been made. For example, a patent to Worden (U.S. Pat. No. 534,704) discloses a drawbridge with two hingeably connected bridge leaves on each side that fold together when retracted. However, this structure may still be difficult to use as it employs no counter weight. It must also utilize heavy structural members since once closed and ready for traffic it is essentially two cantilevered beams. Supporting weight in the center of the bridge is more difficult with this arrangement.

In consideration of the limitations of the devices disclosed in the prior art discussed above, it should be apparent that an effective solution to the problem of quickly and efficiently reversibly spanning a distance with a bridge is needed. Accordingly, the present invention was developed and provides significant advantages over previous bridges used to reversibly span over waterways and other obstacles.

SUMMARY OF THE INVENTION

The present invention overcomes the drawbacks inherent in conventional drawbridges, discussed above, by providing a combination of (1) strong cantilevered beam sections that slide horizontally and lock together to form a rigid span, (2) bascular leaf sections pivotally connected on each side, and (3) hinged leaf sections pivotally connected to the bascular leaf sections on their outside ends and riding on the beam sections at their inside ends.

Specifically, in accordance with a preferred embodiment of this invention, a drawbridge apparatus for reversibly spanning from a first base to a second base is provided. A preferred embodiment of the apparatus includes a first cantilevered beam, a first bascular leaf, and a first hinged leaf. The first cantilevered beam has an extended end and a base end slidably coupled to the first base. Sliding of the first cantilevered beam projects the beam at least partially from the first base to the second base. The first bascular leaf has a first counterweight portion and a first span portion. This leaf is pivotally coupled to the first base at an intersection of the first counterweight portion and the first span portion. The first hinged leaf has a base end pivotally coupled to the span portion of the first bascular leaf and an extended end coupled to the first cantilevered beam.

The preferred embodiment further includes a second cantilevered beam, a second bascular leaf, and a second hinged leaf. The second cantilevered beam has an extended end and a base end slidably coupled to the second base. Sliding of the second cantilevered beam projects the beam at least partially from the second base to the first base. The second bascular leaf has a counterweight portion and a span portion. This leaf is pivotally coupled to the second base at an intersection of its counterweight portion and its span portion. The second hinged leaf has a base end pivotally coupled to the span portion of the second bascular leaf and an extended end coupled to the second cantilevered beam.

In accordance with a particular aspect of this invention, the first cantilevered beam and the second cantilevered beam are arranged and configured opposite each other on intersecting paths so that as each projects from their respective bases the beams interconnect at their extended ends. The base ends of the beams stay coupled to the bases.

In accordance with another particular aspect of this invention, the extended end of the first cantilevered beam includes an interlocking shaft. The extended end of the second cantilevered beam includes an interlocking sleeve sized to receive the interlocking shaft of the first cantilevered beam when the two come together.

In one particular embodiment of this invention, the extended end of the first hinged leaf is pivotally coupled to the extended end of the first cantilevered beam. This arrangement causes the first hinged leaf and the first bascular leaf to move in response to sliding of the first cantilevered beam.

In accordance with the preferred embodiment of this invention, the extended end of the first hinged leaf is slidably coupled to the extended end of the first cantilevered beam. Furthermore, a leaf drive mechanism is coupled to the first base and the first bascular leaf for pivoting the bascular leaf relative to the first base.

In the preferred embodiment of this invention, the leaf drive mechanism comprises a curved rack, a leaf drive motor, and a leaf pinion gear. The curved rack is secured to the first base. The leaf drive motor is secured to the first bascular leaf. The leaf pinion gear is coupled to the drive motor and to the counterweight portion of the first bascular leaf, the pinion gear operatively engaging the curved rack.

In accordance with another preferred aspect of this invention, a beam drive mechanism is coupled to the first base and the first cantilevered beam. This provides a way to slide the first cantilevered beam relative to the first base. Preferably the mechanism includes a beam rack, a beam drive motor, and a beam pinion gear. The beam rack is secured to the first cantilevered beam. The beam drive motor is secured to the first base. The beam pinion gear is coupled to the drive motor and operatively engaged with the rack.

In accordance with another preferred aspect of this invention, the first base includes a roadbed having a top surface, the first cantilevered beam being slidably coupled to the first base beneath the top surface of the roadbed. To help hold the beam, wheel trucks are disposed beneath the top surface of the roadbed. The first cantilevered beam is slidably coupled to the first base beneath the top surface of the roadbed with these wheel trucks.

In accordance with an alternate embodiment of this invention, the first cantilevered beam is slidably coupled to the first base above the top surface of the roadbed.

In accordance with another aspect of this invention, the first cantilevered beam has a curved shape.

In accordance with another alternate embodiment of this invention, a method of constructing a fixed-span bridge is provided. The method includes projecting cantilevered beams over an obstacle to be bridged, fastening the inward ends of the cantilevered beams together, and constructing the fixed bridge on the extended beams.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

Figure 1:
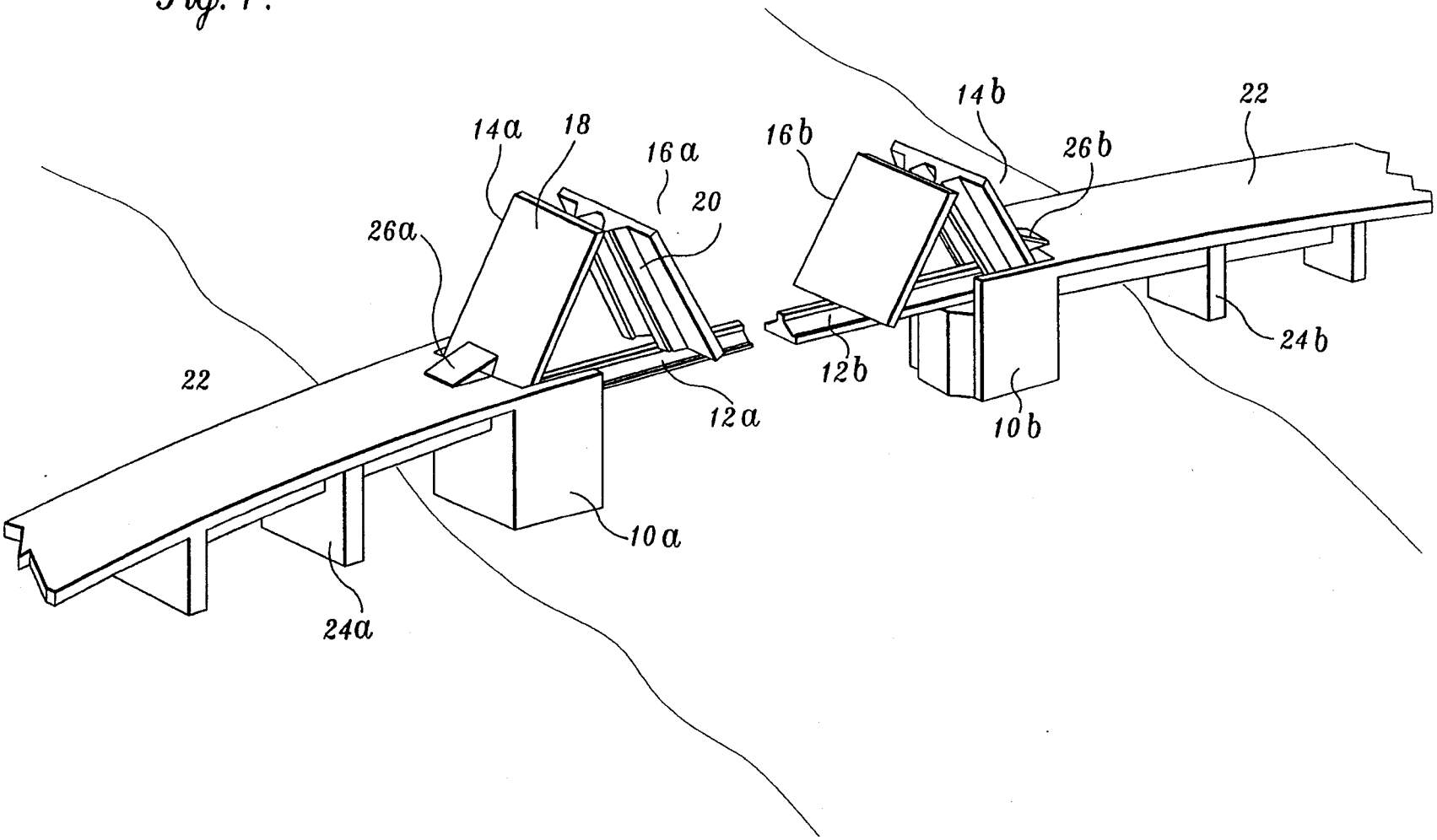
FIG. 1 illustrates a perspective view of a curved embodiment of the invention showing the bridge in a partially open position.

Referring to FIG. 1, a drawbridge 8 of the present invention is supported on piers 10*a*, 10*b*, and includes girders 12, bascular leaves 14, hinged leaves 16, and a bridge deck 18 supported by trusses 20. Piers 10 rise vertically from the ground to provide support for the drawbridge. The distance between piers 10 is the distance to be spanned reversibly by the drawbridge. Girders 12 are cantilever beams slidably coupled to piers 10, such that they may be horizontally extended or retracted to and from piers 10. In the preferred embodiment of the invention, when fully extended girders 12 interlock at their extended ends and form a rigid span (i.e., a simple beam). in this extended position, one-third of the total length of girder 12*a* is extended between piers 10 and one-third of girder 12*b* is extended between piers 10. Two-thirds of each of girders 12 is behind the inward surfaces of piers 10, the inward surfaces facing the obstacle to be spanned.

Bascular leaves 14 are pivotally connected to piers 10 near their outward ends. Bascular leaves 14 have a generally rectangular shape with support trusses on their bottom sides. Bascular leaves 14, also include, inward ends closest to the obstacle to be spanned and opposing outward ends, the inward ends being opposite piers 10, the outward ends being coupled to piers 10. The inward ends of bascular leaves 14 are pivotally connected to hinged leaves 16. Hinged leaves 16 are slidably connected to girders 12. Hinged leaves 16 also have outward ends connected to bascular leaves 16 and inward ends opposite the outward ends. Hinged leaves 16 are also generally rectangular shaped and include trusses on their bottom sides.

Drawbridge 8 is opened by first pivoting the inward ends of bascular leaves 14 upwardly. This causes corresponding upward movement of the outward ends of hinged leaves 16 since these leaves are hingeably connected to the inward ends of bascular leaves 14. As bridge leaves 14, 16 are folded upwardly hinged leaves 16 move along girders 12. After movement along girders 12 approximately half-way to piers 10, girders 12 unlock from one another and begin to retract toward piers 10. Hinged leaves 14, 16 continue to rise and fold together and girders 12 continue to retract until substantially flush with the inward-facing sides of piers 10. In this open position boats, for example, are allowed to freely pass between piers 10.

Drawbridge 8 is closed by simply reversing the above-described process.

Girders 12 provide most of the structural support for the drawbridge. Because of this, and because of the folding configuration of leaves 14, 16, drawbridge 8 can be opened and closed very quickly relative to conventional drawbridges. Bridge leaves 14, 16 can be quickly folded together since their weight is held to a minimum since they are not required to provide all of the structural support needed to support the traffic on bridge deck 18. Also, their retraction is quick due to their folding configuration requiring that the weight which they do have is only effectively lifted half as high as would otherwise be required. The folding bridge of the present invention also has less wind resistance compared to bridges that do not have two sets of folding leaves. Even though girders 12 may be structurally quite strong and heavy, opening the bridge does not require girders 12 to be lifted. Girders 12 are simply rolled back behind the inward faces of piers 10 underneath a road deck 22. Rolling movement of girders 12 in this manner can be performed quickly. Thus, with the above-described construction, traffic waiting on road deck 22 for boats to pass will not also have to wait for the slow opening and closing of drawbridge 8. This will also be a benefit to the vessels traveling between piers 10 since they will not have to wait as long for drawbridge 8 to open or for the drawbridge operator to decide to hold up traffic since traffic will not have to be held up for nearly as long.

Secondary supports 24 are also illustrated in FIG. 1. Secondary supports 24 are located outwardly of piers 10 and extend from road deck 22 to the ground. These supports, and others, provide additional support to road deck 22 as the level of drawbridge 8 is brought to the main road surface. Transition plates 26 are also illustrated which cover the gap in drawbridge 8 necessitated by the pivotal movement of bascular leaves 14. Transition plates 26 are generally rectangular shaped and are attached near the outward ends of bascular leaves 14.

Figure 2A:
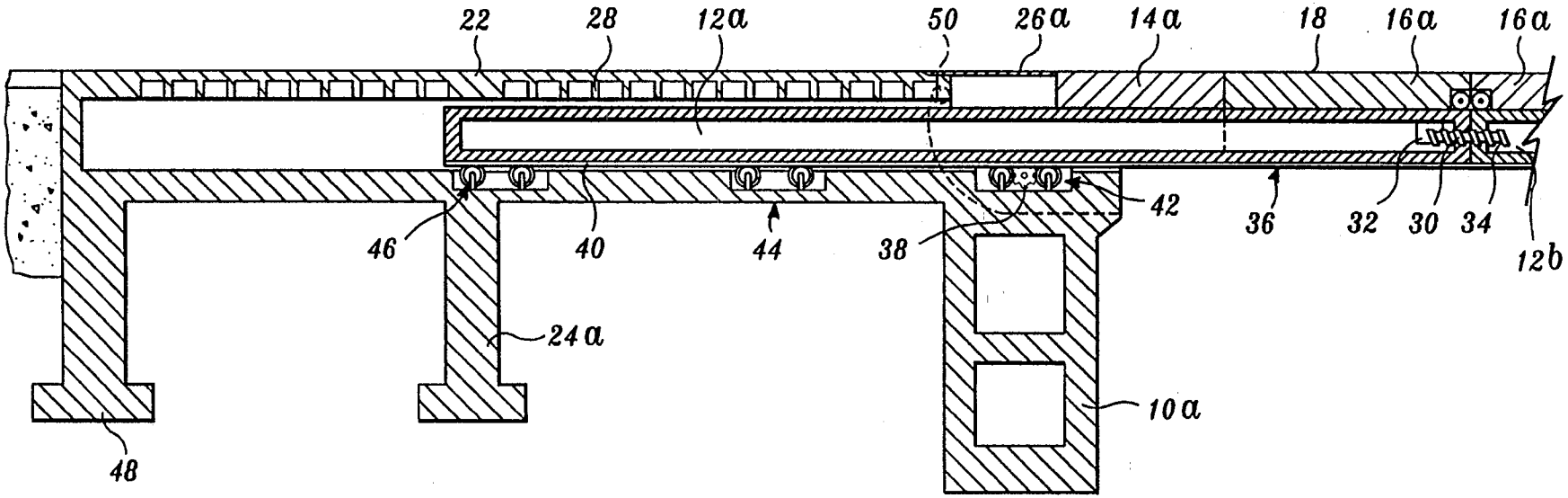
FIG. 2A illustrates a cross-sectional view through the center of the bridge of the present invention in a closed position.

Referring to FIG. 2A, transition plate 26A is coupled between bascular leaf **14*a* and road deck 22. Road deck 22 and bridge deck 18 also include joists 28 which support the surface of these decks 22, 18. Bridge deck 18 forms the top surface of leaves 14, 16. When drawbridge 8 is in an extended position, bridge deck 18 is aligned with road deck 22**.

The mechanism for locking girders 12 together at their inward ends is also shown in FIG. 2A. In a closed configuration the locking mechanism includes a coupling bolt 30 that protrudes from girder **12*a* and is received within girder 12*b*. Coupling bolt 30 has a longitudinal axis aligned with the longitudinal axes of girders 12. A bolt driver 32 secured within girder 12*a* secures the end of coupling bolt 30 and drives coupling bolt 30 within a bolt receiver coupling 34 of girder 12*b*. Coupling bolt 30 has threads which engage bolt receiver coupling 34 to cause girders 12*a* and 12*b*** to be securely joined together such that they act as one rigid span.

Figure 2B:
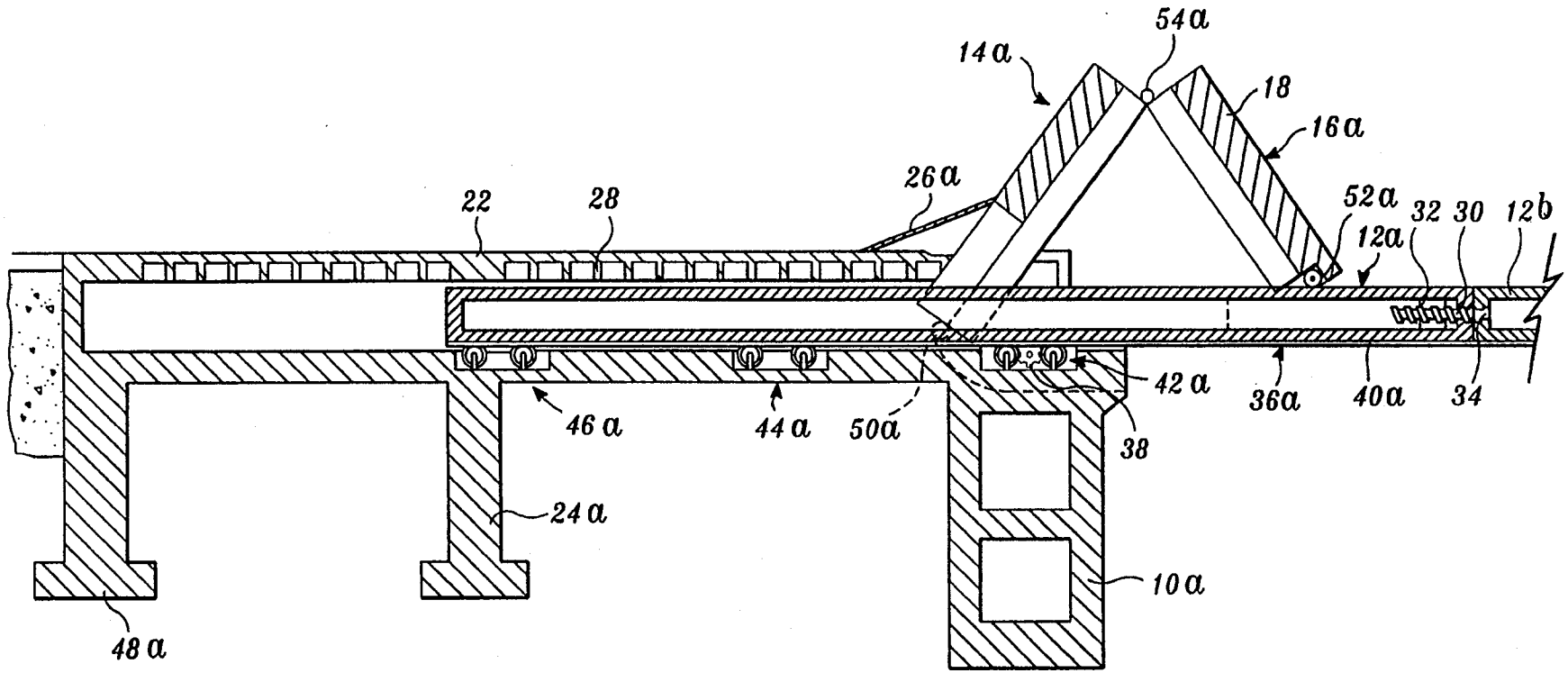
FIG. 2B illustrates a cross section of the bridge of FIG. 2A showing the bridge leaves beginning to fold together.

FIG. 2B illustrates the initial movement of the elements of drawbridge 8 as girders 12 are just about to open. At this point leaves 14, 16 have already begun to fold together and coupling bolt 30 has been driven by bolt driver 32 out of bolt receiver coupling 34. Girder racks 36 are secured to the underside of girders 12. Girder racks 36 are engaged by girder drive pinion 38 so that girder drive pinion 38 can move girders 12 into a retracted position under road deck 22. Girder racks 36 are oriented with their longitudinal axes parallel to the longitudinal axis of girders 12. Two such girder racks 36 are positioned parallel to each other on each of girders 12. Girder drive pinions 38 are rotatably secured to upper portions of piers 10.

Rails 40 are also positioned and secured on the underside of girders 12. Each girder 12 has two rails 40 secured parallel to the longitudinal axes of girders 12 on opposite sides of the undersides of girders 12. Rails 40 ride upon a series of trucks 42, 44, 46. Forward trucks 42 are secured within a top portion of piers 10. Rearward trucks 46 are located two-thirds of the way under road deck 22 to be positioned at the rearward end of girders 12 when girders 12 are in an interlocking position. Central trucks 44 are located between rearward trucks 46 and forward trucks 42. Each of trucks 42, 44, 46 include two sets of wheels with side flanges similar to railroad trucks. Rails 40 tide upon trucks 42, 44, 46 and are kept upon trucks 42, 44, 46 by fitting between the flanges on the wheels of the trucks.

Figure 2C:
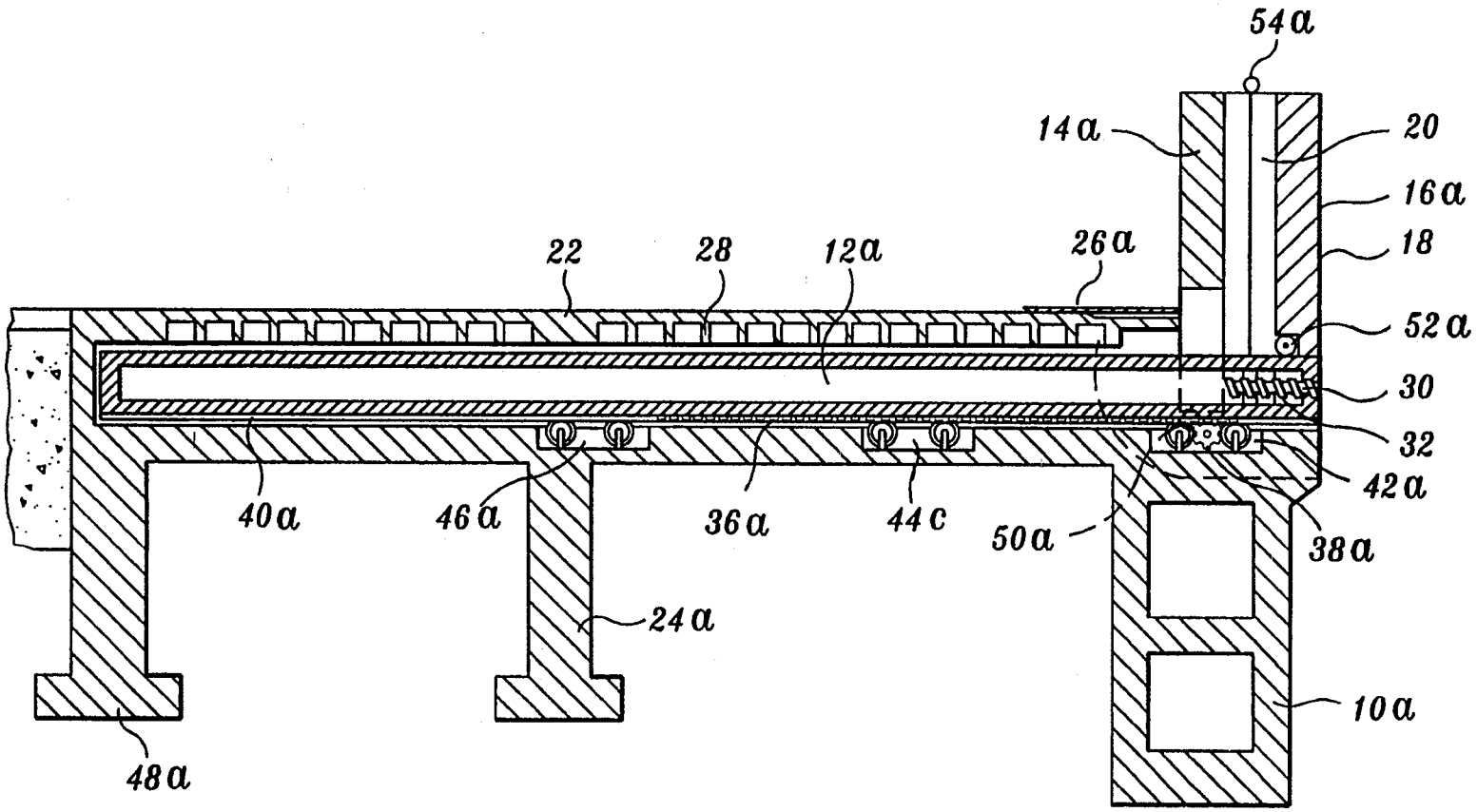
FIG. 2C illustrates a cross section of the bridge of FIG. 2A with the girder retracted and the leaves folded together.

FIG. 2C illustrates one side of drawbridge 8 of the present invention in a fully retracted position. The other side of drawbridge 8 is the mirror image of the side shown in FIG. 2C. Both bascular leaf **14*a* and hinged leaf 16*a* are in an upright position folded together. Girder 12*a* is in a fully retracted position beneath road deck 22 such that the forward end of girder 12*a* is substantially flush with the inward side of pier 10*a*. This is a result of girder drive pinion 38A having driven girder rack 36A rearwardly and girder 12*a* having rails 40 tiding on trucks 42*a*, 44*a*, 46*a*. A comparison of FIGS. 2A and 2C illustrates that at least two-thirds of girder 12*a* is always resting between forward trucks 42A and rearward trucks 46A. This configuration provides ample support for girder 12*a*** whether in a retracted position, a middle position, or a fully extended position.

Closing drawbridge 8 is simply a reversal of the above-described process going from FIG. 2C back to FIG. 2A.

Figure 3:
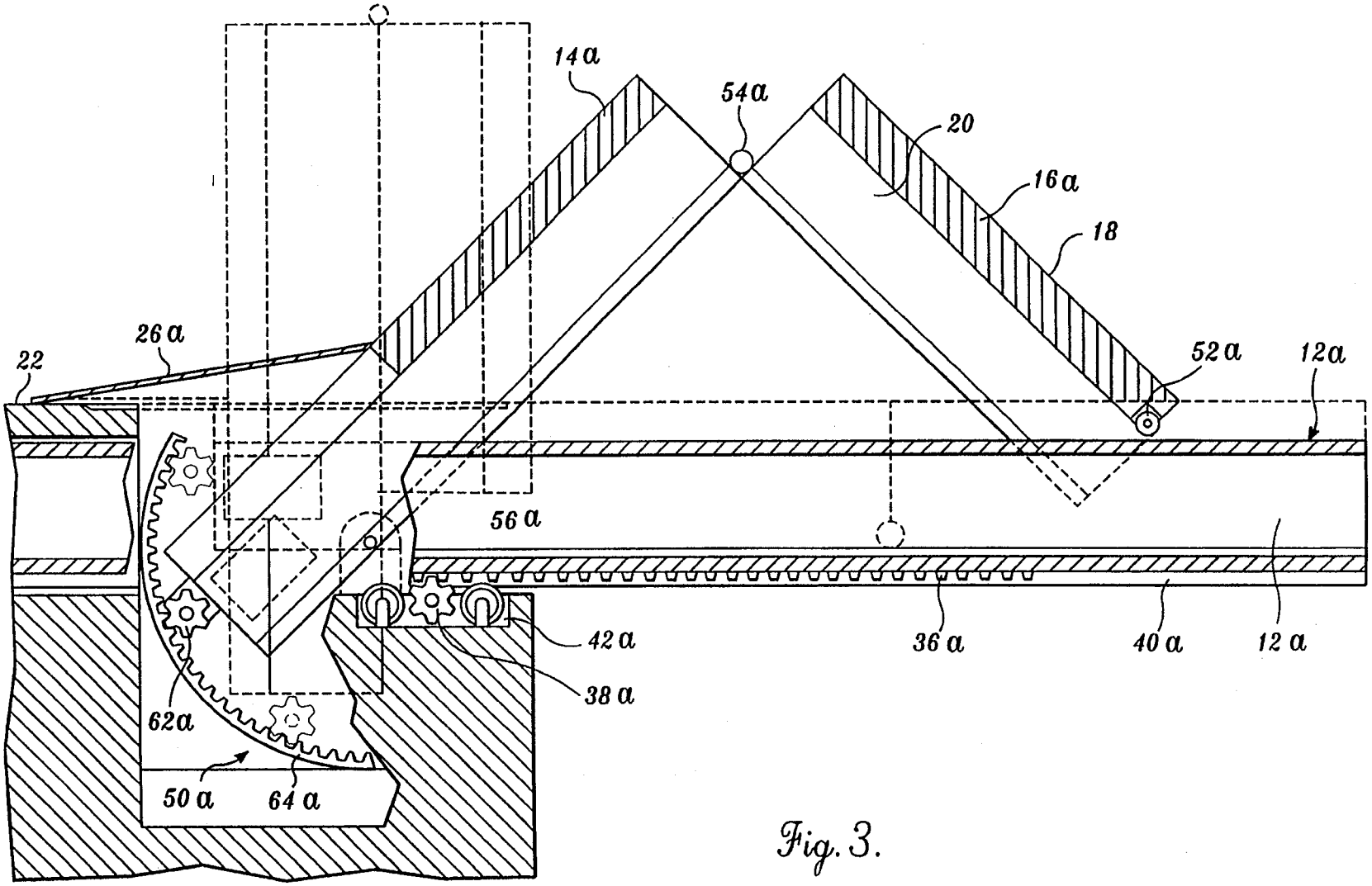
FIG. 3 is a cross-sectional view of a portion of the bridge of FIG. 3 illustrating the pivotal movement of the bridge leaves as driven by the rack and pinion.

Referring now to FIG. 3, the details of the movement of leaves 14, 16 will be described. A leaf drive mechanism 50 drives each set of leaves 14, 16. Leaf drive mechanism **50*a* includes leaf rider wheel 52*a*, leaf hinges 54*a*, trunnions 56*a*, trunnion frames 58*a*, counterweights 60*a*, leaf drive pinions 62*a*, leaf racks 64*a*, and rack pits 66*a*. Leaf rider wheel 52*a* is positioned at the center of the inward end of hinged leaf 16*a*. Leaf rider wheel 52*a* is positioned between trusses 20 such that it rides on a top ridge 70*a* of girder 12*a* when leaves 14, 16 begin to rise. Leaf rider wheel 52*a* then travels along top ridge 70*a* of girder 12*a* until leaves 14*a*, 16*a* are folded together in an upright position. At this point, girder 12*a* is still traveling in a rearward direction and leaf rider wheel 52*a* simply allows girder 12*a*** to ride beneath it.

Leaf hinges **54*a* are situated between bascular leaf 14*a* and hinged leaf 16*a* and form a pivotal connection between these two leaves. Leaf hinges 54*a* are received within recesses within the inward end of bascular leaf 14*a* and the rearward end of hinged leaf 16*a*. One leaf hinge 54*a* is located at the base of each side of trusses 20. Having two leaf hinges 54*a* laterally separated and connecting leaves 14, 16 provides a three-point connection system for hinged leaf 16*a* such that it is always maintained secure. Leaf hinges 54*a* are located above the bottom surface of trusses 20 such that when in an extended position on girder 12***a*, the bottom edge of trusses 20 can seat flat upon side flanges 72 of girder 12*a*.

Trunnions 56*a* are connected through a lower portion of trusses 20 of bascular leaf 14*a* near the rearward end of bascular leaf 14*a*. Trunnions 56*a* are supported above pier 10*a* by trunnion frames 58*a*. Trunnions 56*a* run in a direction perpendicular to the longitudinal axis of bascular leaf 14*a*. Trunnions 56*a* allow bascular leaf 14*a* to be pivoted into a folded position with hinged leaf 16*a*.

Counterweights 60*a* are constructed of dense material such that their weight is sufficient to substantially offset the weight of leaves 14*a*, 16*a* forward of trunnions 56*a*. Some of the weight of leaves 14*a*, 16*a* rides on leaf rider wheel 52*a*. However, counterweights 60*a* must still compensate for a large portion of the remaining weight to be lifted as leaves 14*a*, 16*a* are brought together in a folded vertical position. The horizontal distance from the center of mass of counterweights 60*a* to trunnions 56*a* determines the leverage of counterweight 60*a*. Note in FIG. 3 that the maximum leverage of the center of mass of counterweights 60*a* occurs when the center of mass of counterweights 60*a* are directly horizontally across from trunnions 56*a*. This occurs after leaves 14*a*, 16*a* have already begun to rise. The center of mass of counterweights 60*a* when the bridge is in an extended position is slightly forward of the rearward most position. This is due to the location of trunnions 56*a* being below counterweights 60*a*. This arrangement requires slightly more force to begin movement of leaves 14*a*, 16*a* in an upward direction than is required once leaves 14*a*, 16*a* have moved slightly upwardly, but ensures greater stability of leaves 14*a*, 16*a* when placed upon girder 12*a*. As leaves 14*a*, 16*a* continue to rise and fold together, less counterbalancing is required. Correspondingly, counterweights 60*a* move horizontally closer to trunnions 56*a*.

The driving force behind the folding movement of leaves 14*a*, 16*a* is provided by leaf drive pinions 62*a* in cooperation with leaf racks 64*a*. Leaf racks 64*a* are concentric with trunnions 56*a* such that leaf drive pinions 62*a* always engage leaf racks 64*a* as bascular leaf 14*a* is pivoted. Leaf racks 64*a* are secured within rack pits 66*a* which define recesses within pier 10*a*. One rack pit 66*a* is located on each side of pier 10*a*. Sufficient space between rack pits 66*a* exists for movement of girder 12*a* between them.

Figure 4:
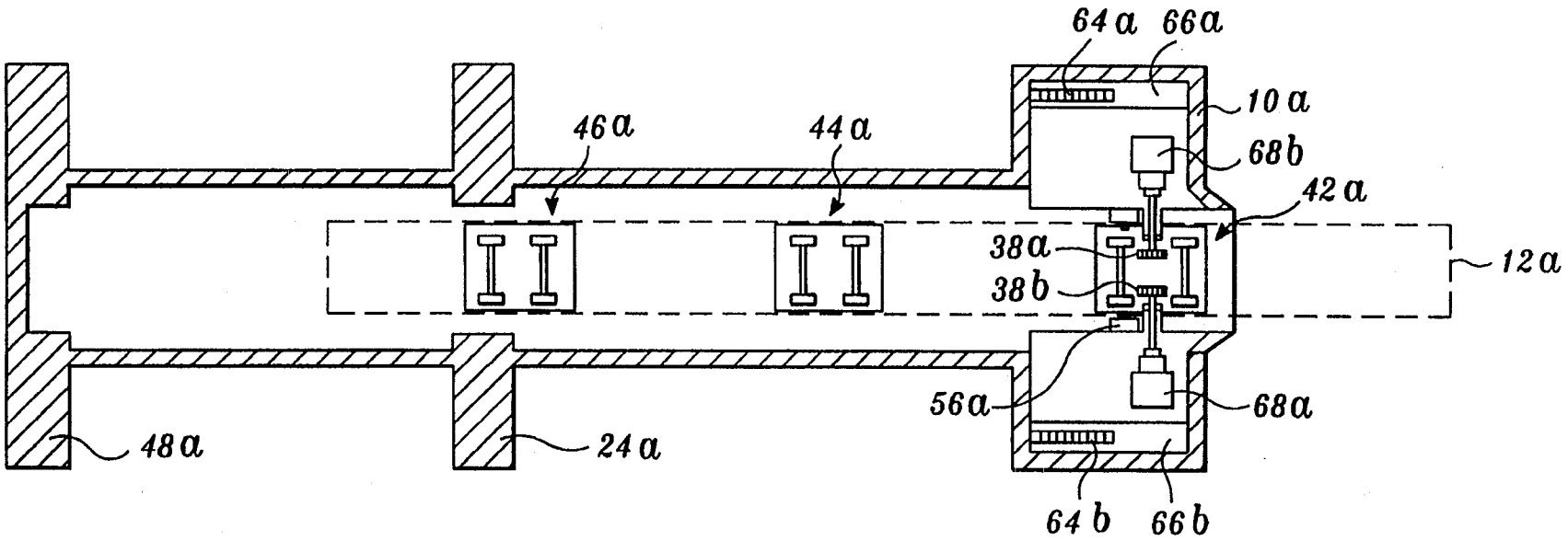
FIG. 4 is a cross-sectional plan view of one side of the support structure for the bridge of FIG. 2.

FIG. 4 illustrates the arrangement of trucks 42, 44, 46 as well as the girder drive mechanism and leaf racks 64. Girder racks 36 are located between rails 40 such that girder drive pinions 38 are located inward of the wheels of trucks 42A. Girder drive motors 68 drive girder drive pinions 38 through a shaft connected between the two that extends between forward and rearward sets of wheels of forward trucks 42. Trunnions 56*a* are located above the rearward set of wheels of forward trucks 42.

Figure 5:
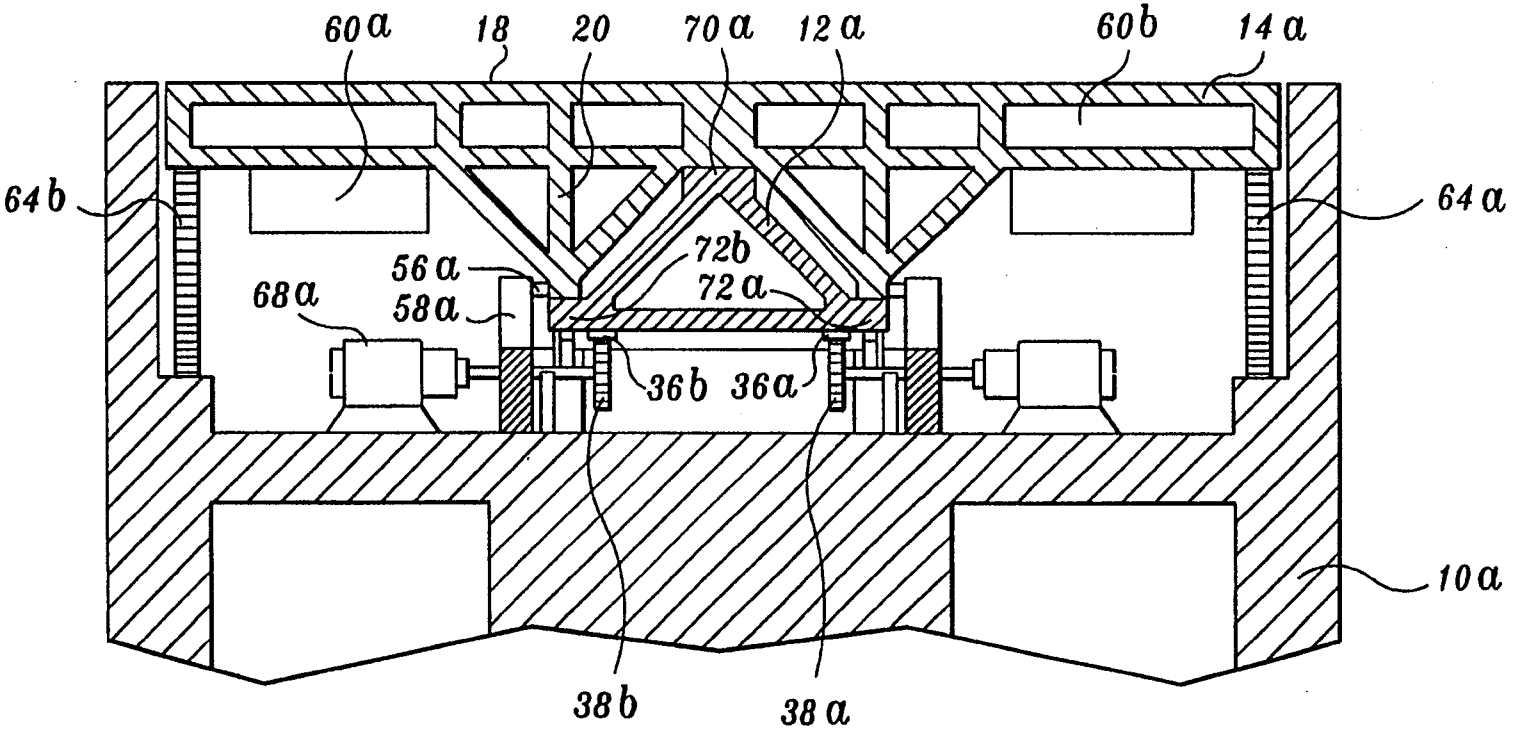
FIG. 5 is a cross-sectional end view through a pier and the bridge of FIG. 2 showing the bridge deck, trusses, the girder, and the drive means.

The sectional view shown in FIG. 5 is from a vertical cut between girder drive motors 68 and the forward wheels of forward trucks 42A. Bascular leaf 14*a* rests upon top ridge 70*a* and side flanges 72 and is pivotally connected to trunnions 56. The "W" shape of trusses 20 provides structural support for bascular leaf 14*a* while not substantially increasing the weight of bascular leaf 14*a*. Trusses 20 provide mainly lateral support for bridge deck 18. Girder 12*a* provides most of the structural support for the bridge and thereby decreases the required structural weight of bascular leaf 14*a* as well as hinged leaf 16*a*.

Leaf racks 64 are located at the outward most end of bascular leaf 14*a* on the far lateral sides. Counterweights 60 are positioned just inwardly of leaf racks 64. Trusses 20 then angle down to trunnions 56 supported by trunnion frames 58. Before being pivoted upwardly, trusses 20 rest upon the top side of side flanges 72 of girder 12*a*. On the bottom side of side flanges 72 rails 40 project downwardly to engage and ride upon the wheels of trucks 42, 44, 46. Each of the wheels of trucks 42, 44, 46 have side flanges to keep rails 40 in proper alignment. Girder racks 36 are located parallel to and on the inside of rails 40. Girder racks 36 are securely fastened to the bottom side of girder 12. As explained above, girder drive pinions 38 engage girder rack 36 to extend or retract girder 12.

Figure 6:
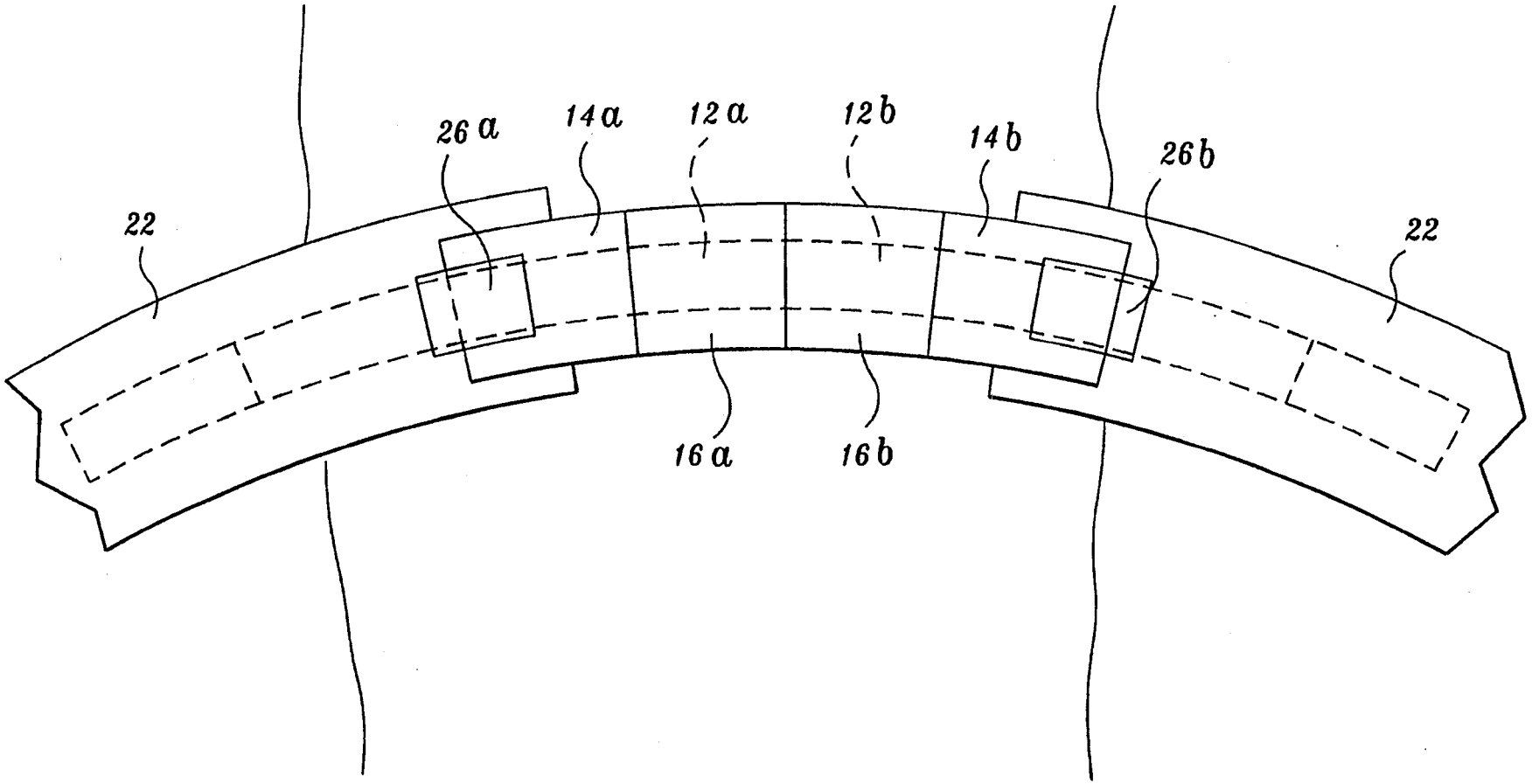
FIG. 6 is a plan view of the curved embodiment of the bridge.

FIG. 6 illustrates a curved embodiment of drawbridge 8 of the present invention. The interface between the road deck 22 and bascular leaves 14 is perpendicular to the tangent to the curve at that location. Likewise, the intersection between bascular leaves 14 and hinged leaves 16 are also perpendicular to the tangents of the curve at those locations. Finally, the intersection of hinged leaves 16 also has an interface which may or may not be perpendicular to the tangent of the curve at that point. The connections requiring a perpendicular orientation are those between bascular leaves 14 and hinged leaves 16 and between bascular leaves 14 and piers 10. This is required so that the end of hinged leaf 16 will ride along girder 12 when folded together with bascular leaf 14. While the interface between bascular leaf 14 and road deck 22 is not required to be perpendicular to the tangent at that location, the connection between them must be. Trunnions 56 which pivotally connect bascular leaf 14 to piers 10 must connect to trusses 20 along an axis which is perpendicular to the tangent of the curve at that location. This configuration provides that all movement is along a common path of the curve. It should be noted that both sides of drawbridge 8 do not have to be formed along the same continuous curve. One side could be straight while the other curved. The only connection between the two is at their interface where hinged leaves 16 and girders 12 meet for coupling bolt 30 to be inserted therebetween.

The advantages of the above-described invention are numerous. For example, drawbridge 8 can be opened and closed more quickly than previous drawbridges. The upward movement of leaves 14, 16 can be quick due to both their lighter weight and the fact that they fold together. Since the leaves fold together, the raised bridge will only be half as high compared to a bridge where the leaves did not fold. The weight of leaves 14, 16 is lower since most of the structural support for bridge traffic is provided by girders 12. Girders 12 can be quickly extended and retracted since they are simply rolled along a substantially horizontal path. Lifting of girders 12 is not required.

The mechanism that locks girders 12 together also provides significant advantages. Once locked together, girders 12 act as a simple fixed beam not as two independent cantilevered beams. The strength of drawbridge 8 when in position for traffic is thus increased, lowering the structural requirements of girders 12. The weight and cost of construction is consequentially lowered as well.

Since leaves 14, 16 fold together and accordingly have a height less than the combined length of the leaves, each opened side of drawbridge 8 has less wind resistance. Greater opening spans are also possible with the drawbridge construction of the present invention due to folding leaves 14, 16, the lower weight of all bridge components, and the retraction and extension systems of girders 12.

Another advantage of drawbridge 8 is its ability to be constructed in a curved configuration. This option helps avoid problems or obstructions on either side of a waterway or other obstacle being bridged. Drawbridge 8 can also be banked when needed to further increase design options and meet existing highway design constraints.

An alternate embodiment of this invention utilizes movable girders 12 to construct a fixed-span bridge instead of a drawbridge. To construct the fixed bridge girders 12 are projected from piers 10, in a manner similar to that described above with respect to drawbridge 8, until they meet at their inward ends. The inward ends are then fastened together securely to form a simple fixed beam. This beam then acts as a support on which to construct a fixed span bridge. The ends of girders 12 may be fastened together with any conventional fastening method, or may be secured together in a manner similar to that described above for drawbridge 8.

While the preferred embodiments of the invention have been illustrated and described, it will be appreciated that various changes can be made therein without departing from the spirit and scope of the invention.

The embodiments of the invention in which an exclusive property or privilege is claimed are defined as follows:

1. A drawbridge apparatus comprising:

(a) first base;

(b) a second base;

(c) a first cantilevered beam having an extended end and a base end slidably coupled to the first base, wherein sliding of the first cantilevered beam projects the beam in a direction that is toward the second base;

(d) a first bascular leaf having a first counterweight portion and a first span portion, said first bascular leaf being pivotally coupled to the first base at an intersection of the first counterweight portion and the first span portion; and (e) a first hinged leaf having a first base end pivotally coupled to the first span portion of the first bascular leaf and a first extended end coupled to the first cantilevered beam.

2. The apparatus of claim 1, further comprising:

(a) a second cantilevered beam having an extended end and a base end slidably coupled to the second base, wherein sliding of the second cantilevered beam projects the beam in a direction that is toward the first base;

(b) a second bascular leaf having a second counterweight portion and a second span portion, said second bascular leaf being pivotally coupled to the second base at an intersection of the second counterweight portion and the second span portion; and (c) a second hinged leaf having a second base end pivotally coupled to the second span portion of the second bascular leaf and a second extended end coupled to the second cantilevered beam.

3. The apparatus of claim 2, wherein the first cantilevered beam and the second cantilevered beam are arranged and configured opposite each other on intersecting paths so that as each projects from the bases the first cantilevered beam and the second cantilevered beam interconnect at their extended ends, the base ends of the cantilevered beams being coupled to the bases.

4. The apparatus of claim 3, wherein the extended end of the first cantilevered beam further comprises an interlocking shaft, and wherein the extended end of the second cantilevered beam further comprises an interlocking sleeve sized to receive the interlocking shaft of the first cantilevered beam.

5. The apparatus of claim 1, wherein the extended end of the first hinged leaf is pivotally coupled to the extended end of the first cantilevered beam so that the first hinged leaf and the first bascular leaf move in response to sliding of the first cantilevered beam.

6. The apparatus of claim 1, wherein the extended end of the first hinged leaf is slidably coupled to the extended end of the first cantilevered beam.

7. The apparatus of claim 6, further comprising a leaf drive means coupled to the first base and the first bascular leaf for pivoting the first bascular leaf relative to the first base.

8. The apparatus of claim 7, wherein said leaf drive means comprise:

(a) a curved rack secured to the first base;

(b) a leaf drive motor secured to the first bascular leaf; and (c) a leaf pinion gear coupled to the drive motor and to the counterweight portion of the first bascular leaf, said pinion gear operatively engaging the curved rack.

9. The apparatus of claim 1, further comprising a beam drive means coupled to the first base and the first cantilevered beam for sliding the first cantilevered beam relative to the first base.

10. The apparatus of claim 1, wherein said beam drive means comprise:

(a) a beam rack secured to the first cantilevered beam;

(b) a beam drive motor secured to the first base; and (c) a beam pinion gear coupled to the drive motor and operatively engaging the rack.

11. The apparatus of claim 1, wherein the first base comprises a roadbed having a top surface, the first cantilevered beam being slidably coupled to the first base above the top surface of the roadbed.

12. The apparatus of claim 1, wherein the first base comprises a roadbed having a top surface, the first cantilevered beam being slidably coupled to the first base beneath the top surface of the roadbed.

13. The apparatus of claim 12, further comprises a plurality of wheel trucks disposed beneath the top surface of the roadbed, wherein the first cantilevered beam is slidably coupled to the first base beneath the top surface of the roadbed with said wheel trucks.

14. The apparatus of claim 1, wherein the first cantilevered beam has a curved shape.

15. A drawbridge apparatus comprising:

(a) a first base;

(b) a second base;

(c) a cantilevered beam slidably coupled to the first base, wherein sliding of the cantilevered beam projects the beam at least partially from the first base to the second base;

(d) a bascular leaf having a counterweight portion and a span portion, said bascular leaf being pivotally coupled to the first base; and (e) a hinged leaf having a base end pivotally coupled to the span portion of the bascular leaf and an extended end coupled to the cantilevered beam.

16. A drawbridge apparatus comprising:

(a) a first pier;
(b) a second pier;
(c) first and second cantilevered beams slidably coupled to the first and second piers, respectively, wherein said beams are arranged and configured to project from the first and second piers to a location between the two piers at which location said beams interconnect;
(d) beam drive means for sliding the first and second cantilevered beams from and into first and second piers, respectively;
(e) first and second bascular leaves having first and second counterweight portions and first and second span portions, respectively, said first and second bascular leaves being pivotally coupled to first and second bases, respectively, at the intersections of the respective counterweight portion with the respective span portion;
(f) first and second hinged leaves having first and second base ends pivotally coupled to the respective first and second span portions of the bascular leaves, said hinged leaves also having first and second extended ends slidably coupled to the first and second cantilevered beams, respectively; and
(g) leaf drive means for pivoting the first and second bascular leaves.

17. A drawbridge apparatus comprising:
(a) a first base;
(b) a second base;
(c) a first cantilevered beam having an extended end and a base end slidably coupled to the first base, wherein sliding of the first cantilevered beam projects the beam in the direction of the first base to the second base; and
(d) a first bascular leaf pivotally coupled to the first base wherein said first bascular leaf is adapted to pivot between a retracted position, wherein said first bascular leaf extend from its pivotal coupling with the first base at an angle relative to the cantilevered beam, and an extended position, wherein the first bascular leaf rests on and extends along the cantilevered beam.

* * * * *